US005544600A

United States Patent [19]

Hunt

[11] Patent Number: 5,544,600

[45] Date of Patent: Aug. 13, 1996

[54] KNEE CONTROL MECHANISM FOR INDUSTRIAL SEWING MACHINE

[75] Inventor: Morris D. Hunt, Stantonville, Tenn.

[73] Assignee: DBH Limited, Inc., Adamsville, Tenn.

[21] Appl. No.: 232,882

[22] Filed: Apr. 25, 1994

[51] Int. Cl.[6] ..... D05B 69/06; G05G 1/14; G05G 1/20

[52] U.S. Cl. ..... 112/217.3; 74/512; 74/515 R

[58] Field of Search ..... 112/217.3, 217.4, 112/284; 74/515 R, 519, 512, 513, 560, 56 R; 108/5, 25, 32, 43; 248/444.1, 441.2, 445

[56] References Cited

U.S. PATENT DOCUMENTS

| | | | |
|---|---|---|---|
| 126,152 | 4/1872 | Mills | 74/515 |
| D. 337,214 | 7/1993 | Barrons et al. | 6/431 |
| 1,010,599 | 12/1911 | Delaney et al. | 74/515 |
| 1,092,095 | 3/1914 | De Clark | 74/515 |
| 1,565,362 | 12/1925 | Hemleb | 112/217.3 |
| 1,721,070 | 7/1929 | Chason | 112/217.3 |
| 1,857,371 | 5/1932 | Gail | 112/2.1 |
| 1,947,827 | 2/1934 | Chason | 112/217.3 |
| 2,065,428 | 12/1936 | Chason | 112/217.3 |
| 2,103,557 | 12/1937 | Sawdey et al. | 74/515 |
| 2,127,209 | 8/1938 | Duchan | 74/515 |
| 2,183,366 | 12/1939 | Chason et al. | 112/217.3 X |
| 2,952,164 | 9/1960 | Hofgesang | 74/515 |
| 3,068,821 | 12/1962 | Hermanns | 112/217.4 X |
| 3,083,654 | 4/1963 | Cash, Sr. | 112/2.1 |
| 5,233,278 | 8/1993 | Carter | 112/217.4 X |
| 5,253,545 | 10/1993 | Barrons et al. | 74/512 |
| 5,322,084 | 6/1994 | Ghiassian | 74/512 |

*Primary Examiner*—Ismael Izaguirre
*Attorney, Agent, or Firm*—Kalish & Gilster

[57] ABSTRACT

A knee control mechanism is provided for operation of a machine. The mechanism includes at least one knee contact surface operatively connected to the machine in such manner as to permit operation of the machine while the operator is standing with both feet firmly placed on the floor at all times. The knee control mechanism is positioned forwardly of and substantially entirely to either one of the right and left sides of the operator.

16 Claims, 9 Drawing Sheets

KNEE CONTROL MECHANISM FOR INDUSTRIAL SEWING MACHINE

BACKGROUND AND SUMMARY OF THE INVENTION

The present invention relates generally to the field of knee controls for machines, and, more particularly, to a knee control mechanism for attachment to industrial machines, such as sewing machines used in the garment and upholstery industries, during operation of which the machine operator is in the standing position.

Previously, control mechanisms for operation of sewing machines were limited in that they generally were structured for use in only the seated position and were generally not adaptable for use in the standing position. Also, many known machine controls were only useful for in home purposes and not well suited for adaption to industrial grade equipment.

Furthermore, most known foot and knee control devices cannot be adjusted for individual operator preferences or needs, due to body size differences, right or left hand operation, and the like. These limitations are particularly important in industrial situations where increased fatigue and errors result from by staying in one position too long, thereby decreasing efficiency of the entire manufacturing operation. Of course, operator fatigue also results in increased injuries, and general health problems which may add to employee time off work.

Also, with many known machine controls it is necessary for a standing operator to have his or her weight on only one leg during at least a substantial part of the time of operation, in order to foot-operate the machine with full control of the machine speed, direction of operation, and other various machine functions. Such limited operator positioning of course lends itself to muscle cramping, back injuries, muscle strains, etc., with the expected negative results in work performance.

In the present knee control mechanism the operator stands and is able to move the knees freely in two basic movements, forwardly and rearwardly (i.e., in and out) or to one side or the other of the operator. Typically, but not necessarily, with the new mechanism, movement of either or both of the knees forwardly, in, away from the operator, makes the machine go faster, and is usually progressive in nature. However, a more "on" and "off" nature of control can be attained, depending upon the particular combination of switching and power elements provided, as will be clear from the following description.

Known industrial machines, such as sewing machines, typically use either a clutch operated motor or an electronically controlled motor. Knee controls have existed for use with either one or the other, but in both cases limitations existed. These are avoided with the new mechanism when used with an electronically controlled electric motor. Certain of these known mechanisms were mounted by attachment directly to the underside of a stand or tabletop upon which the machine being driven, such as a sewing head, is supported.

Thus, in instances where the table top is vertically adjustable, the knee control mechanism attached therebeneath is necessarily simultaneously moved up and down to an equal extent with movement of the table top. This may be quite undesireable and limiting to the machine operator who may wish, for example, to have the work surface higher, but not have the height of the knee control pedals shifted. These known devices were simply not structured for attachment or operative support other than by connection to the table top.

Furthermore, known knee controls are generally not adjustable other than by vertically moving the work surface to which the control is connected. Generally, very little or no adjustment in any other direction is possible.

Another limitation with such previously known knee controls is that they occupy a great deal of longitudinal space beneath the work surface, which space is often at a premium, being needed for attachment or other placement of other, accessory equipment, particularly near the center of the table where the operator is often required to stand. The structure of known devices generally severely limits or makes impossible the connection of some other equipment, and often requires positioning of the speed controller and/or motor in an awkward or otherwise undesireable position.

By contrast, the new knee control mechanism is structured for connection to the stand or other support structure, off to either the right or left of the operator's usually standing position, and is not connected to the table top at all. So, the height of the work surface can be selectively adjusted completely independently from the height of the new knee control mechanism. Additionally, the speed controller can be positioned completely at the back of the machinery, out of the operator's way and out of the way of other equipment.

The new mechanism is structured so as not to occupy such a large amount of space beneath the work surface, and instead has a generally narrow construction which, except for the main knee push plate, usually extends transversely of the of the work surface and off to one side of the operator so as to be out of the way, as well as being rapidly adjustable in an extremely facile manner.

With the new knee control mechanism the in-and-out knee movement discussed may start from a neutral position or from a braked (completely stopped) or other machine condition. In such a case the forward knee movement first takes the machine out of whatever condition it is in (eg. stopped) and then causes it to progressively operate faster.

The second basic knee movement offered with the new control mechanism is side-to-side. Either the left knee is moved to the left or the right knee is moved to the operator's right, depending upon the structure selected. Typically these movements cause a function of a switching, on/off nature, rather than being gradual or progressive. In the example shown and described hereafter, there are three "off" or "on" functions. With movement, a lever connected to a knee contact surface activates a first function, then with continued movement in the same direction the lever activates a second function, and so on, to the third function. Of course, other functions could be operated in like manner if so desired.

The mechanism illustrated and described herein allows sideways knee movement control only to the operator's right. However, by similar and appropriate "mirror-image" construction, as will be made clear, the mechanism can have the facility to provide control just as well by knee movement initiated to the operator's left.

Accordingly, it is among the several advantages of the present invention to provide a knee control mechanism for a machine, especially an industrial sewing machine, which is operated by knee pressure while the standing operator has both feet firmly on the ground at all times during machine operation.

It is also among the advantages of the invention, having the features indicated, to provide a machine knee control mechanism which can be selectively adjustable in more than one direction for increased versatility, in order to accommodate the individual needs and preferences of the machine operator to facilitate maximum productivity. These adjustments are intended to be accomplished at least in part by structural features of the knee control mechanism per se, and may also be accomplished in part by structural adaptations of the mechanism which permit it to be mounted on a frame or some other assembly for selective directional adjustment in relation to the machine to be operated by the mechanism.

It is further among the advantages of the present invention, having the features indicated, that the new knee control mechanism be economical to manufacture and relatively simple to operate in a facile and safe manner by a machine operator having little or no additional training and which mechanism may be adapted for operation with either the left or right knee of the operator, as may be desired, and which permits a substantial amount of machine control with only two basic knee movements.

It is also among the advantages of the present invention to provide a knee control mechanism, having the above features, which can be incorporated into new equipment and which is also suitable of attachment to existing machines for more efficient use thereof; and further which, if desired, permits rapid removal of portions of the mechanism to facilitate access to other parts of the equipment to which it is attached, for example, for access to a foot control mechanism also associated with the machine to be controlled.

Thus, the present invention is, briefly, the combination of a machine and a knee control mechanism for operation thereof. The mechanism has at least one knee contact surface operatively connected to the machine in such manner as to permit operation of the machine while the operator is standing with both feet firmly placed on the floor at all times. The knee control mechanism is positioned forwardly of and substantially entirely to either one of the right and left sides of the operator.

The invention is further, briefly, a knee control mechanism for standing operation of a machine. The mechanism includes a plurality of knee contact surfaces operatively mounted in connection with the machine, a plurality of fluid cylinders selectively contacted by the plurality of knee contact surfaces, and a speed control device connected to at least one of the plurality of fluid cylinders and controlled by selective activation of at least one of the plurality of knee contact surfaces.

Other objects and advantages will be in part apparent and in part pointed out hereinbelow.

BRIEF DESCRIPTION OF THE DRAWINGS

Throughout the various figures like parts are indicated by like element numbers.

DESCRIPTION OF THE PREFERRED EMBODIMENT

Figure 11:
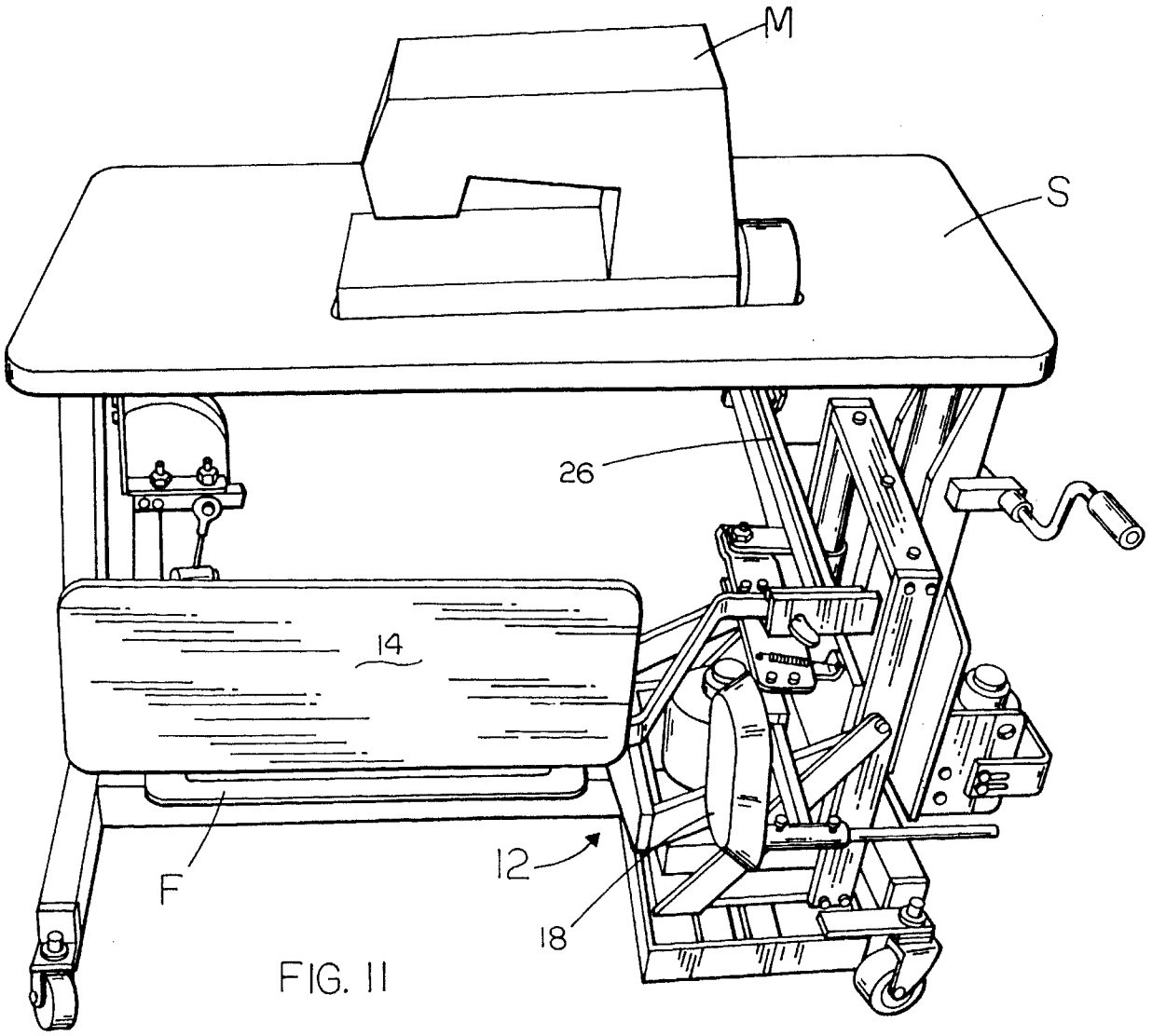
FIG. 11 is a front perspective view of the knee control mechanism of FIG. 1 connected to an industrial sewing machine which is mounted on an ergonomic stand having an adjustable foot pedal attached thereto.
Figure 12:
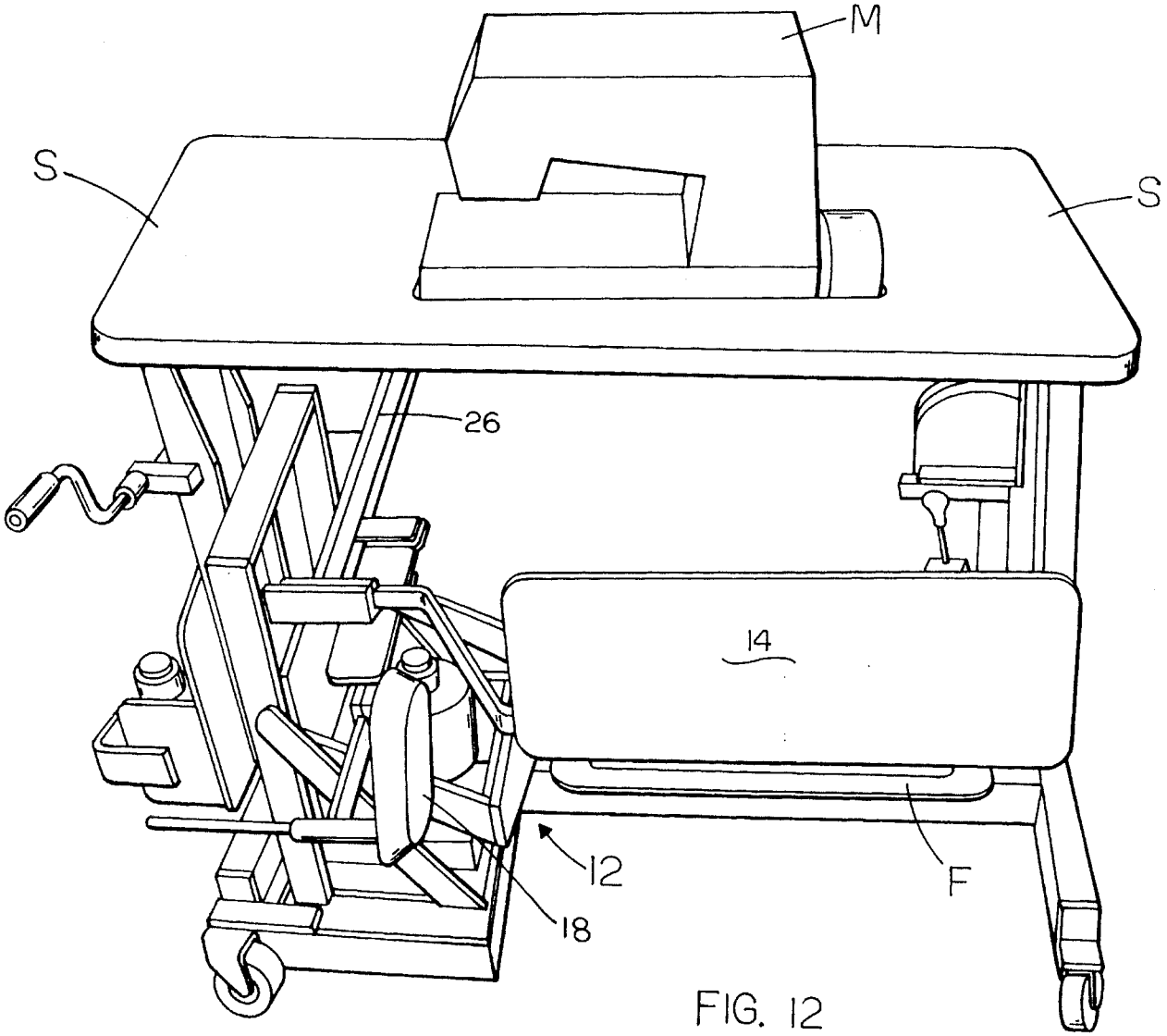
FIG. 12 is a schematic view of the knee control mechanism of FIG. 11, reversed, so as to be mounted substantially to the machine operator's left side.

With reference to the drawings, and particularly with regard to FIG. 11, 12 generally designates an adjustable knee control mechanism for use in operating a machine, such as an industrial sewing machine M, which is preferably, but not necessarily, mounted for operation on an adjustable ergonomic stand S and a foot pedal assembly F, such as those shown in U.S. Pat. Nos. 337,214 and 5,253,545, which are incorporated herein by reference.

Alternatively, stand S may not be of the adjustable or ergonomic type, but can merely have a fixed, table-like form. Moreover, machine M could be of some other type and could conceivably be free-standing, not supported by a stand S. It is to be understood that the knee control mechanism described herein, rather than being positioned directly beneath the machine and mounted on the foot pedal assembly shown for easy adjustment therewith, could be otherwise supported, completely independently of the machine, on a frame or other independent support structure. Also, the new knee control mechanism could be attached directly to the legs of a stand upon which the machine to be controlled is supported, or connected to some other structure associated with the machine.

For clarity and simplicity of the drawings and discussion thereof, it is to be understood that not all elements are shown in all figures, and dimensions and spacing of certain elements may vary slightly among the figures.

Knee control mechanism 12 consists generally of knee contact structures adjustably supported on movable levers which when selectively operated activate switches and cause selective firing of fluid cylinders to thereby control the various machine functions. When connected to an industrial sewing machine, as in the preferred embodiment described herein, knee control mechanism 12 can be used to affect, for example, presser foot position, initiation and stopping of sewing, machine speed, direction (forward and reverse), and various optional functions, such as thread cutting, etc. Machine operations controlled by knee control mechanism 12 will vary as necessary for the job to be accomplished and the type and style of machine to which the mechanism is attached.

More specifically, mechanism 12 preferably has at least two knee contact structures which, as shown herein, consist preferably of a substantially rectangular plate 14 mounted vertically and longitudinally relative to the longitudinal axis of stand S upon which machine M is supported, and a more or less oblong or oval knee press or contact surface 16 which is mounted substantially transversely to the longitudinal axis of stand S. Although both longitudinal plate 14 and transversely extending paddle or press 16 are each shown to have opposed flat front and back surfaces, and so structured, they are relatively inexpensive to manufacture, certainly at least the operator-directed outer (front) surfaces of one of more of these knee contact structures may be formed so as not to be flat. For example, a curved or wavy outer surface can be provided which will function acceptably.

During use of mechanism 12, plate 14 is ordinarily directly in front of an operator (not shown) of machine M and press 16 is disposed to either one side or the other of the operator for lateral knee contact. In the embodiment illustrated press 16 is on the operator's right. However, if preferred, or necessary due to the construction of the particular machine to be operated and other associated equipment, press 16 and parts connected thereto may be formed as a mirror image of that shown, and disposed to the operator's left, and function just as well when appropriately structurally adapted to the particular supporting equipment.

Conceivably, a transverse press 16 can be provided on both the left and right sides of longitudinal plate 14 so that the same machine functions can be accomplished by use of either transverse press, as may be necessary for operators with different preferences or the particular job requirements. Of course, this duplicate structure would occupy more space than is preferred to be allotted to the knee control assembly. Thus, although ordinarily unnecessary and certainly more expensive, if desired, duplicate presses 16 can be mounted in parallel on each of the operator right and left sides of plate 14.

Also, although in the embodiment illustrated the sewing machine M is positioned longitudinally on support stand S and knee control mechanism 12 is supported thereunder by mounting on an adjustable "sit down" foot pedal assembly F for the operator to be positioned to one side of the machine, conceivably with some machines and particular jobs the operator may be positioned at a different point relative to the machine. For example, the operator may stand behind, in front, or on the opposite side of the machine. In such as case, knee control mechanism 12 can be disposed appropriately beneath the stand, or independently thereof, as may be neccesary for access to the work material. In any case, because of the narrow, overall form of mechanism 12 significantly less space is occupied thereby than with known knee control mechanisms.

For operator comfort it is desirable that plate 14 be provided on its outward facing surface with a cusion, such as a coating or thick layer of a known substance, such as foam rubber (not shown), and that press 16 have applied thereover a removable fitted cushioning pad 18, or be similarly coated with foam rubber. Of course, knee control mechanism 12 will function just as well without either of such comfort supplying features.

Figure 1:
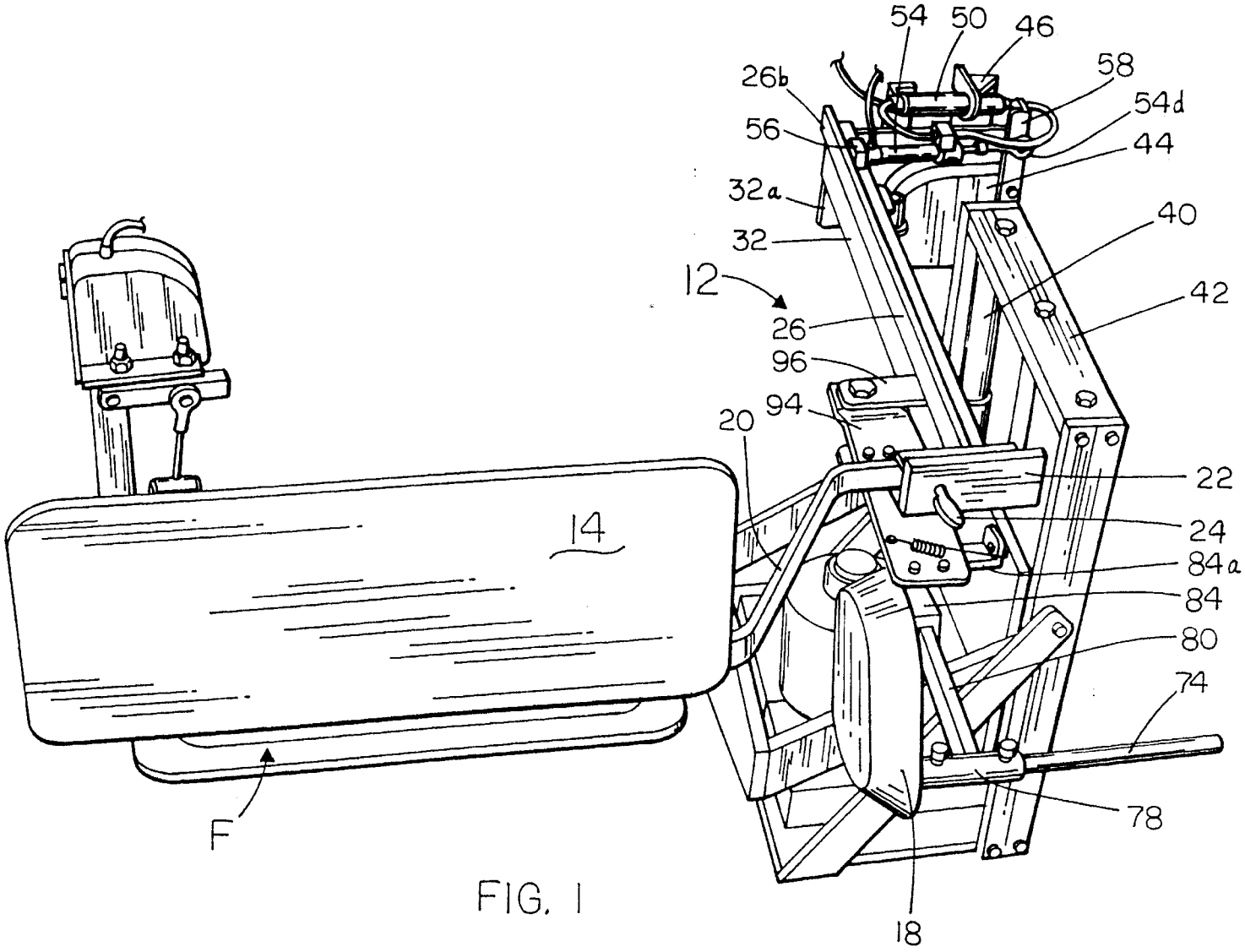
FIG. 1 is a front perspective view of a knee control mechanism for attachment to an industrial sewing machine, which knee control mechanism is constructed in accordance with and embodies the present invention.
Figure 2:
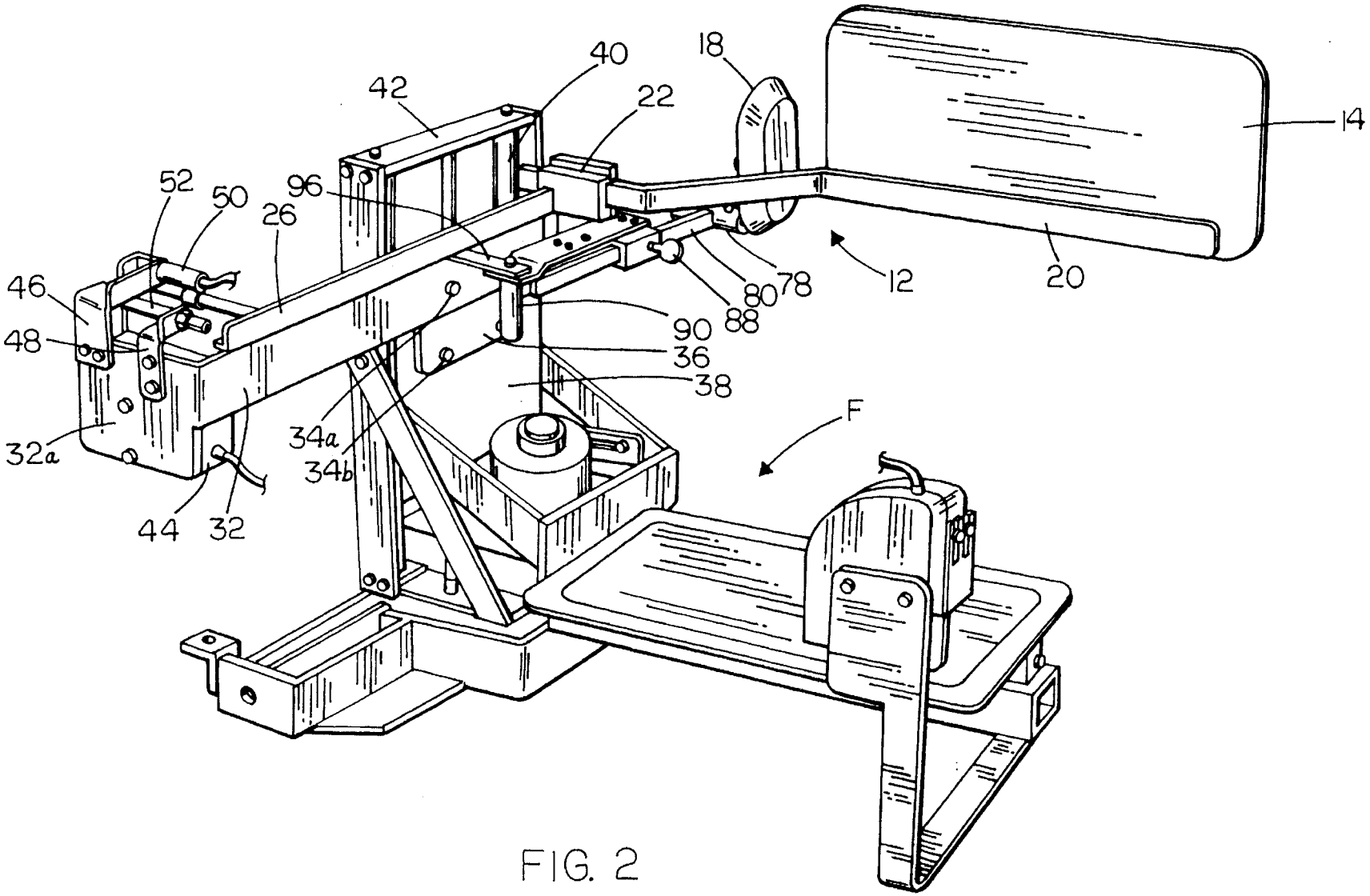
FIG. 2 is a rear perspective view of the knee control mechanism of FIG. 1.

FIGS. 1 and 2 show that longitudinal knee plate 14 is fixed to one end of a support bar 20 which, for strength, desirably extends along the entire length of plate 14 on either of the front or back surfaces thereof. Support bar 20 continues beyond the right edge of plate 14, angles transversely and rearwardly, and then angles rearwardly again in stepped fashion and extends longitudinally to an extreme right end which is slidingly received in a sleeve 22 having an internal cross section corresponding to the sectional shape of angled support bar 20. Angled support bar 20 is preferably rectangular in cross section or otherwise keyed to the shape of sleeve 22 so that rotational slippage cannot occur during repeated operation of plate 14.

A thumb screw 24 or other suitable retainer is received through sleeve 22 and tightened against support bar 20 to secure the bar in its preselected position. If the operator prefers to shift plate 14 to the right or left for convenience or comfort, or to remove it entirely, eg. for access to foot pedal assembly F or other structure beneath stand S, it is an extremely simple matter to loosen thumb screw 24 and then slidably remove bar 20, and plate 14 attached thereto, completely away from retaining sleeve 22.

If desired, eg. to permit access to a foot pedal assembly F, knee push plate 14 can be completely released from its operative position on mechanism 12, flipped over, and handily stored for ready access by sliding the free end of bar 20 into sleeve 22 from the opposite end thereof. So attached for storage, plate 14 merely extends out of the operator's way, to the right of knee press 16.

Figure 5:
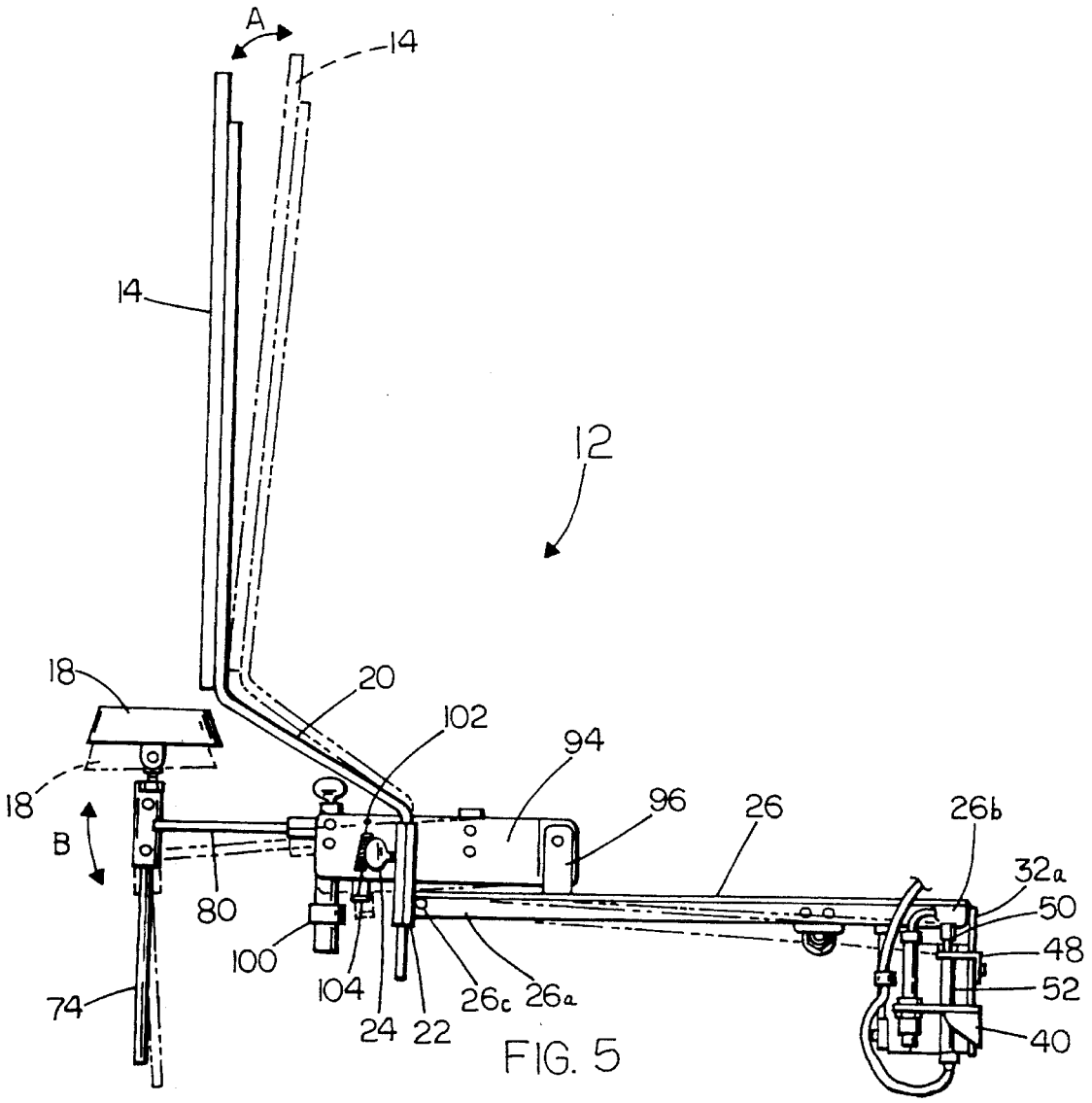
FIG. 5 is a top plan view of the knee control mechanism of FIG. 1, showing an alternative position in phantom.
Figure 6:
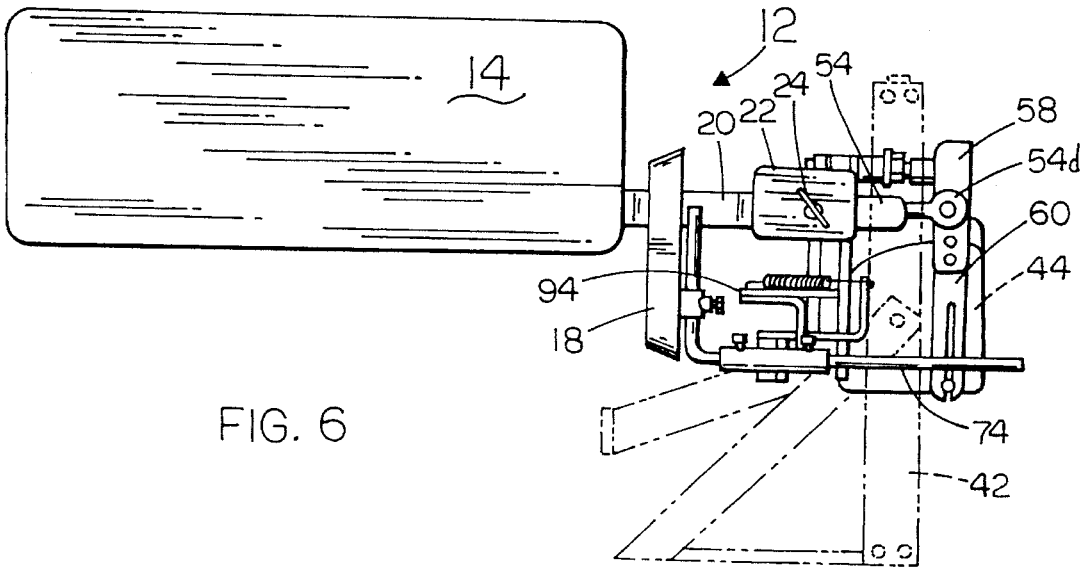
FIG. 6 is a front elevational view of the knee control mechanism of FIG. 1, showing certain supporting structure in phantom.

Sleeve 22 is fixed at the forwardly extreme end **26*a* of a lever 26, perpendicular to the axis thereof, so as to extend longitudinally with relation to stand S. Lever 26 is preferably formed of a section of angle iron which extends rearwardly from sleeve 22, transversely in relation to and beneath stand S. Immediately adjacent to and behind sleeve 22 lever 26 is pivotally mounted to the upper end of a tubular housing 28 which receives a vertically disposed elongated connector, such as bolt 30 (FIG. 10) which rotatably connects housing 28 and the forward end of lever 26. So mounted to lever 26, and by pressing contact by an operator's knee, longitudinal knee plate 14 can move forwardly and back upon release of pressure, as generally indicated by arrows A in FIG. 5**, for selective operation of various controls, as will be discussed further later herein.

Figure 7:
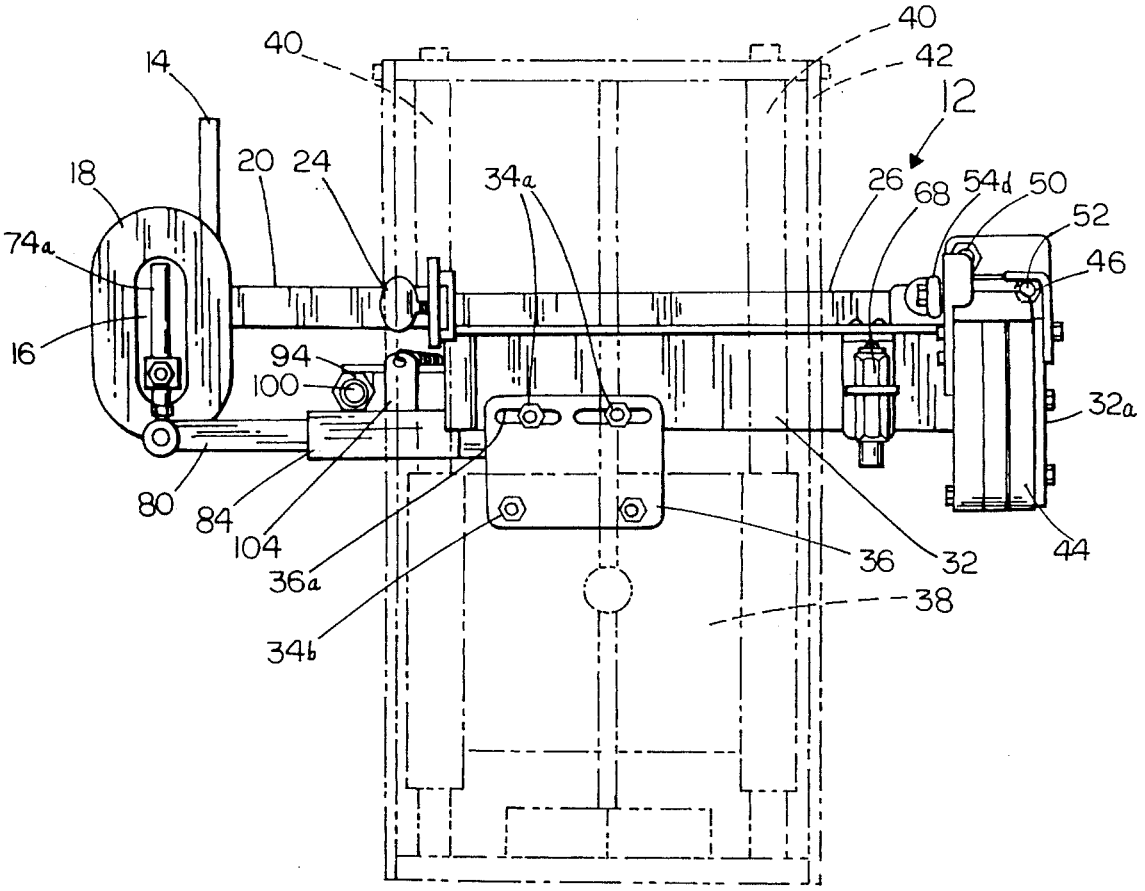
FIG. 7 is an end elevational view taken from the right side of the knee control mechanism of FIG. 1, showing certain supporting structure in phantom.
Figure 8:
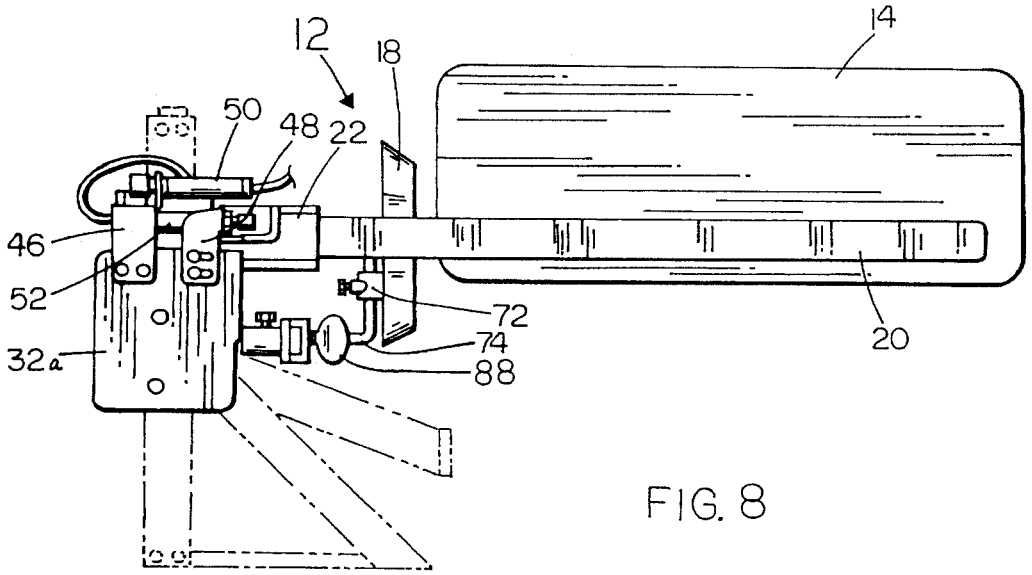
FIG. 8 is a back elevational view of the knee control mechanism of FIG. 1, showing certain supporting structure in phantom.
Figure 9:
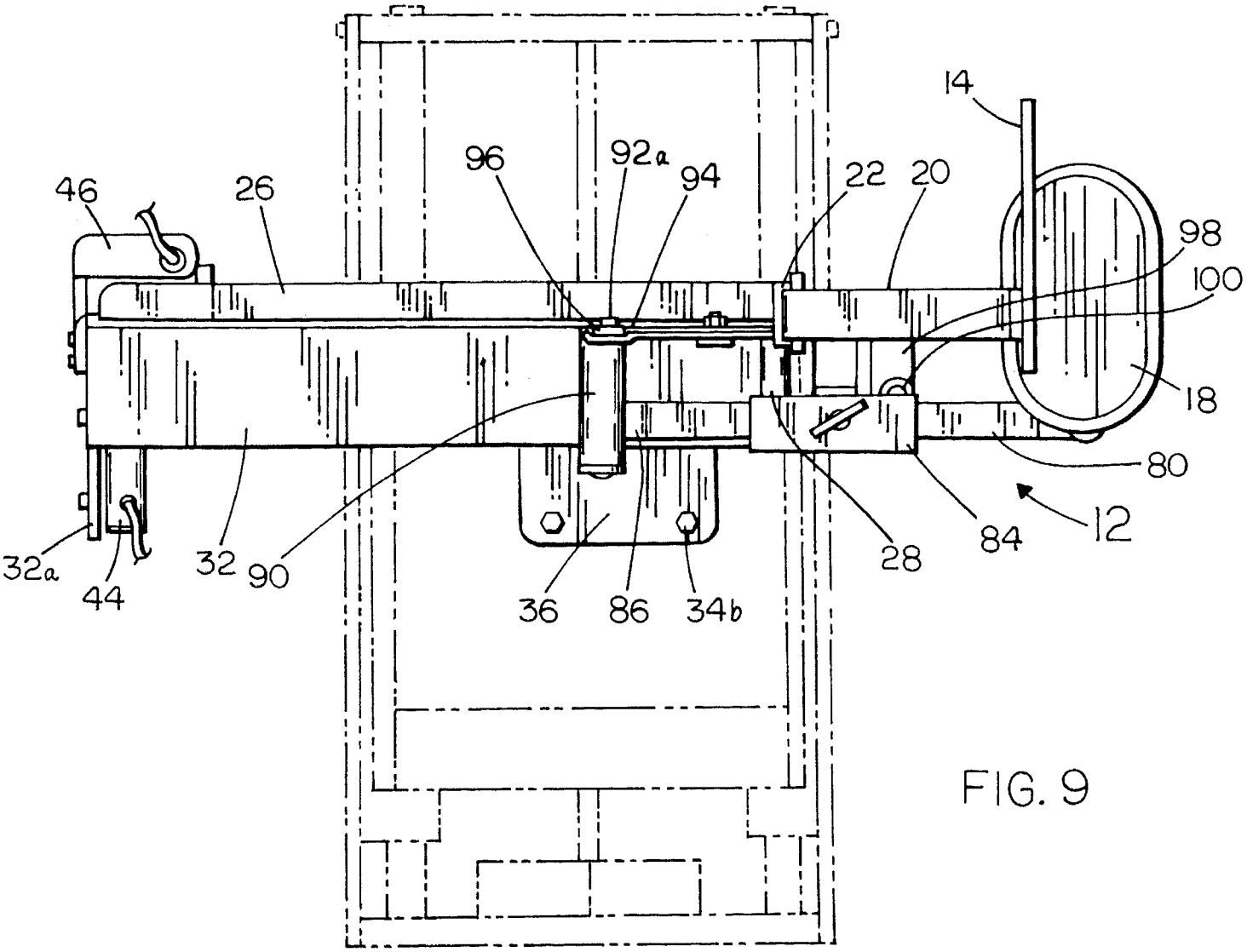
FIG. 9 is an end elevational view taken from the left side of the knee control mechanism of FIG. 1, showing certain supporting structure in phantom.

FIG. 2 illustrates that tubular housing 28 is vertically fixed at the forward end of an elongated rigid bracket 32 which in turn is secured, for example by connectors such as bolts **34*a*, to a transversely and vertically disposed mounting plate 36. FIG. 7 illustrates that mounting plate 36 preferably receives bolts 34*a* in horizontal slots 36*a* to permit such transverse adjustment as may be necessary during mounting of knee control mechanism 12** beneath stand S.

Mounting plate 36 is connected to the supporting structure for machine M and, as shown, is preferably secured, also by connectors such as bolts **34*b*, to a carriage plate 38 for selective vertical movement beneath stand S, for example, on slides 40, which are supported within a vertical frame 42 in such manner as is described in the aforementioned U.S. Pat. No. 5,253,545, with regard to an adjustable foot pedal assembly, generally designated F in FIG. 2**. Such an adjustment may be desirable, for example, in the case of a machine operator who is significantly taller or shorter than average, in order to prevent the press and plate from striking uncomfortably at the shin or thigh levels.

So mounted on foot pedal assembly F, the entire knee control mechanism can be easily adjusted vertically, for example by vertical carriage assembly and push button means (as described in the above-referenced U.S. Pat. No. 5,253,545), to suit the height requirements of a particular operator. This option to vary the height of mechanism 12 is useful both when the operator is to remain standing, as well as if the operator is to be seated on a chair or stool of some type.

Also, by virtue of being mounted as shown on foot pedal assembly F, knee control mechanism 12 can also be readily shifted in and out, that is, toward and away from the operator as desired for comfort or required for a particular job. This forward and back (in and out) adjustment can, by virtue of the structure of foot pedal assembly F, provide a somewhat greater degree of transverse movement, relative to the transverse adjustability offered by the bolt and slot attachment of mounting plate 36 and rigid bracket 32.

Alternatively, although less desirable because of decreased versatility, mounting plate 36 could be vertically fixed beneath stand S, or made vertically adjustable by other conceivable structures. The relative vertical position of knee control mechanism 12 does not affect other structural or functional aspects thereof, but is an optional, although preferred, feature of the new mechanism.

FIG. 2 illustrates that elongated rigid bracket 32 extends transversely and rearwardly (away from the operator), beyond mounting plate 36 and preferably terminates rearwardly in a vertical flange 32*a*, which extends at an angle of approximately 90 degrees to the operator's right side, parallel to the longitudinal axis of stand S. Flange 32*a* provides a mounting site for a speed control device 44 of known variety which is attached by connectors in any known, suitable manner.

At the top edge of flange 32*a* there are connected preferably L-brackets 46, 48 to which are removably mounted fluid cylinders 50, 52, respectively. Cylinders 50, 52 are preferably of the pneumatically-operated, piston containing type and are disposed parallel to the longitudinal axis of stand S, and disposed in this embodiment so that the piston of cylinder 50 fires to the operator's right and the piston of cylinder 52 fires to the operator's left. The purpose and operation of these fluid cylinders will be described later herein.

Figure 3:
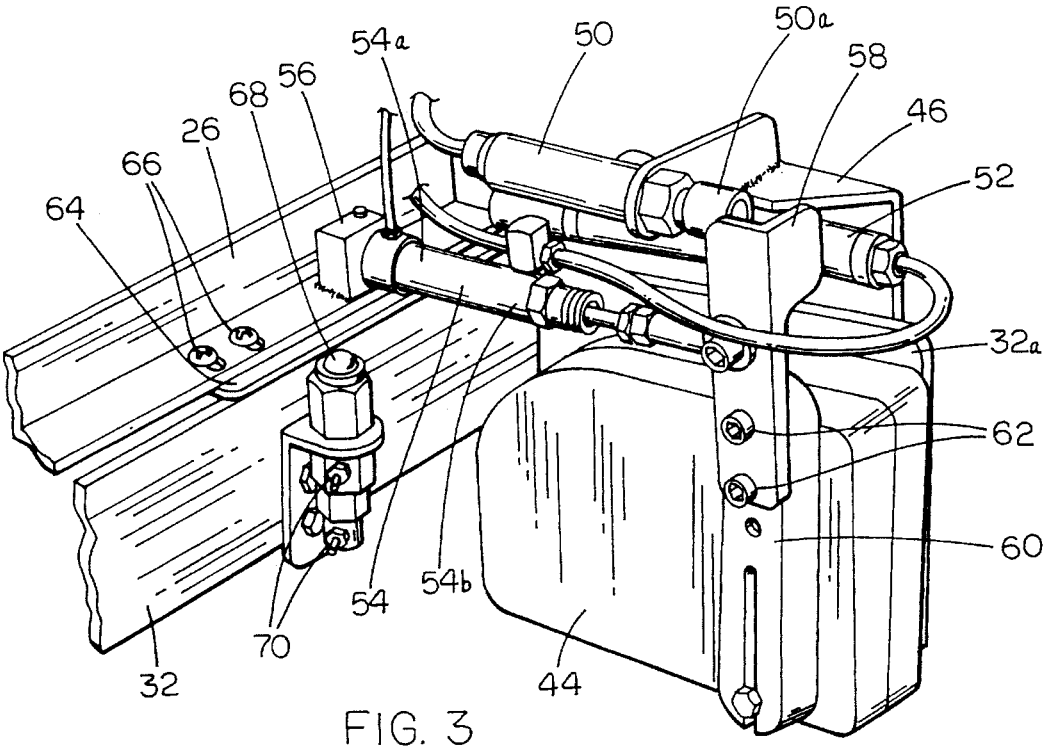
FIG. 3 is an enlarged, partial perspective view of the knee control mechanism of FIG. 1, showing the speed control mechanism.

FIG. 3 shows another fluid cylinder 54 which is connected at one 54*a* of its ends by a mounting block 56 to lever 26 substantially adjacent to rearward lever end 26*b*. At its opposed end 54*b* cylinder 54 has an extendible piston 54*c* which is pivotally connected by a terminal ring 54*d* to a bracket 58 which in turn, at one of its two opposed ends is attached to one end of a dog 60, for example by a plurality of threaded connectors such as allen-headed screw and aperture assemblies 62, and which dog 60 is in turn operatively connected at the other its ends to speed control device 44 for operation thereof, as will be described further hereafter.

FIG. 3 also illustrates that forwardly of mounting block 56 lever 26 is provided with a horizontally extending tab 64 which is preferably adjustably connected to the horizontal arm of lever 26 by connectors such as screw and slot assemblies 66. Tab 64 may thus be selectively positioned as necessary for it to contact a push button switch 68, which is mounted in known fashion on elongated bracket 32, when lever 26 is caused to move by knee contact with plate 14. Push button switch 68 signals certain machine M functions by fluid means connected at fittings 70 in the usual manner.

Figure 4:
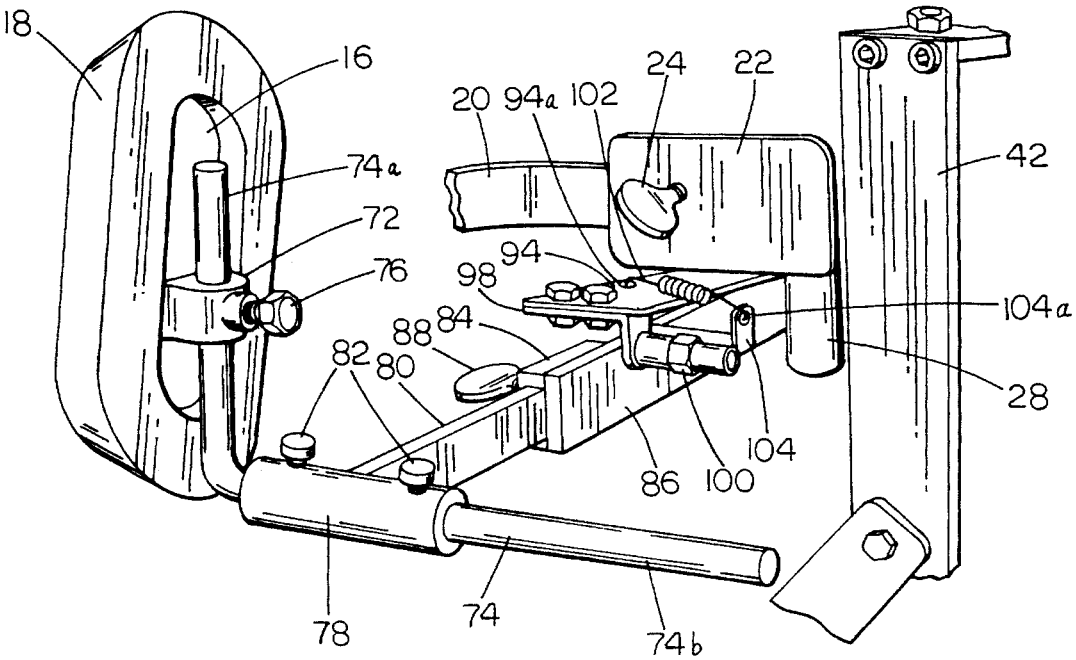
FIG. 4 is an enlarged, partial perspective view of the knee control mechanism of FIG. 1, showing the side press and mounting structure therefor.

With reference to FIG. 4 it may be seen that transversely extending knee press 16 has a bearing 72 fixed to the outside surface, away from the operator. Bearing 72 has a longitudinal opening formed therethrough so as to slidingly receive one leg 74*a* of an L-shaped bar 74 which supports press 16. Press 16 can thus be slidably adjustably positioned along support bar leg 74*a* and then set in a preselected position, for example, by tightening of a threaded bolt 76 which transversely penetrates the side wall of bearing 72 and abuts the exterior surface of leg 74*a*. Other methods of attachment of course can be conceived which will function appropriately.

The other leg 74*b* of support rod 74 extends substantially horizontally and longitudinally in relation to stand S, and is adjustably disposed in such position by passage through a sleeve 78 which is fixed perpendicularly at an outwardly directed end 80*a* of a rigid bar 80. Rod leg 74*b* is secured in its preselected longitudinal position by tightening of screws 82 which penetrate sleeve 78.

Like plate 14, knee press 16 can be set aside for storage and ready access by removing rod 74 from the left end of sleeve 78, flipping it over, 180 degrees, end-to-end, and reinserting end 74*b* into the right end of the sleeve for easily accessible storage of the press.

Rigid bar 80 extends transversely and rearwardly, away from the position of the operator and is adjustably, slidingly received through a sleeve 84 mounted at the end of and longitudinally in relation to the axis of a lever 86. Rigid bar 80 may be relatively flat, or, as shown in FIG. 10, square in cross section, and is secured in its position, preselected to the operator's liking, by tightening of a thumb screw 88 which penetrates the side wall of sleeve 84.

Figure 10:
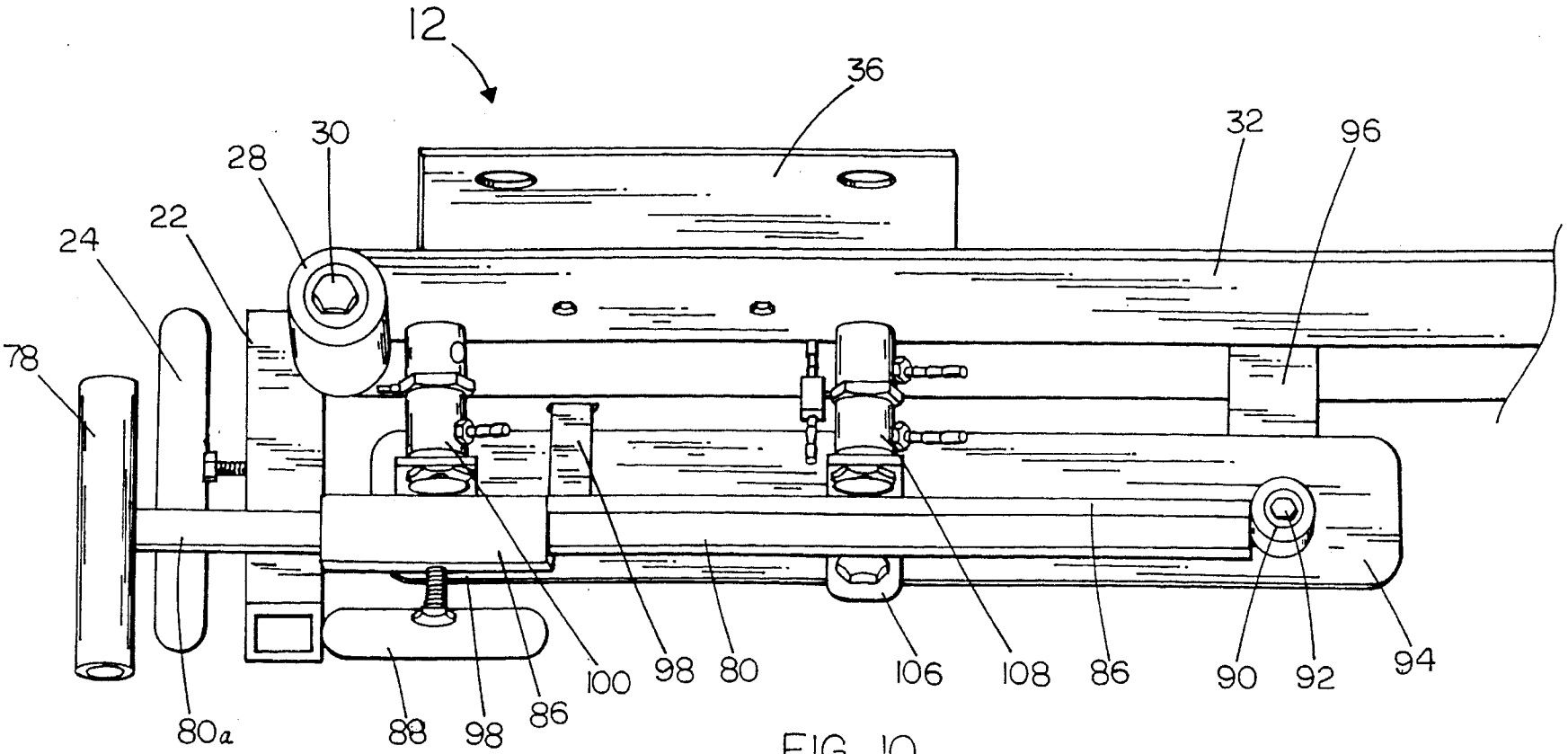
FIG. 10 is an enlarged bottom perspective schematic view of a portion of the knee control mechanism of FIG. 1.

FIG. 10 illustrates that lever 86 extends, preferably straight, transversely and rearwardly and has vertically fixed at its rearward extreme end a tubular bearing or housing 90 which rotatably journals pivot shaft 92. Shaft 92 can be formed, for example, by a bolt which, at its upwardly directed end, penetrates and is attached to an elongated plate 94. Bolt or shaft 92 is rotatably secured to plate 94 by a known connector such as an appropriately sized nut connected to the upper end of the bolt, above the plate.

In the general area of penetration by shaft 92, the rearwardly directed end of plate 94 is connected, preferably by welding, to a bracket 96 which extends horizontally from and is fixed to the previously discussed vertically disposed elongated bracket 32, connected to mounting plate 36.

With reference to FIG. 4, it is seen that adjacent to its forwardly directed end, elongated plate 94 has connected to its undersurface, a relatively small L-bracket 98 which serves as a mounting site for a switch 100 which is disposed substantially longitudinally with relation to stand S and which is contacted by lever 86 when press 16 is contacted by an operator's knee and moved to the right.

As seen in FIG. 4, normally, directly adjacent to and rearwardly of bracket 98 and switch 100 there is an aperture 94*a* formed in plate 94. Aperture 94*a* receives one end of a spring 102. The opposed end of spring 102 is retained in an aperture 104*a* of an L-bracket 104 which is fixed to lever 86 substantially adjacent to and rearward of sleeve 84.

Spring 102 serves to bias lever 86 to the left, toward the operator's working position, for automatic return on release of rightwardly directed knee pressure. In other words, as knee pressure is applied on press 16 to the right, lever 84 pivots horizontally about shaft 92 beneath plate 94, thus forcibly elongating spring 102, until reaching the point of contact by lever 84 with switch 100. Once the rightward pressure on press 16 is released, spring 102 returns lever 86 and press 16 attached thereto, to the normal leftward position.

Rearwardly on the under surface of plate 94, between the center thereof and the pivot point formed at bearing 90 there is connected another bracket 106 to which is connected a switch 108, in normally longitudinal position. When press 16 is activated by knee pressure, as described above, and lever 86 pivots to the right, switch 108 is activated by pressing contact with the right side of lever 86 first, before switch 100, because switch 108 is positioned closer to the lever pivot point at shaft 92.

It is understood, in this example, that switches 100, 108 are both positioned so that the contact points thereof are facing the right side of lever 86. Thus, as press 16 is activated, the support rod and parallel attached lever 86 move to the right, gradually causing contact first with switch 108, then with switch 100. Of course, movement of press 16 can be stopped prior to contact of the second switch, if desired or necessary, depending on the requirements of the job being performed.

As seen most clearly in FIG. 10, switches 100, 108 are of a conventional variety, having the usual fluid connector fittings to permit use in the usual manner. All electrical and fluid (preferably pneumatic) fittings and connections are preferably of known readily available varieties for ease of adaptation to existing equipment. Also, it is preferred that all brackets serving to mount described switches be removably attached, if possible in a fashion which permits their positions to be somewhat adjustable, for example by screw and slot assemblies, for ease of switch replacement, if necessary. Of course, a more permanent connection of brackets, such as 104, 106 can also be used.

The following description of use is to be understood to be exemplary only, with substantially as many variations being possible as there are needs therefor.

In use of the above-described preferred embodiment, an operator standing facing knee plate 14, with press 16 on his or her right depresses plate 14 forwardly to activate speed control device 44. The plate 14 and speed control device 44 are connected in part by cylinder 54 which, in its normal position, always has its piston forcibly extended by continuous fluid pressure, except when transversely extending knee press 16 is activated by operator knee pressure. (Although hydraulic adaptations to mechanism 12 are possible, for safety and neatness all of the described cylinders and any others required are preferred to be pneumatic.)

In response to activation by movement of knee plate lever 26, speed control device 44 sends an electric signal to the machine motor (not shown) to run machine M (or, more specifically, the sewing head thereof). When forward pressure is released from knee plate 14 the motor automatically returns to an idle or neutral position.

Substantially simultaneously with pressure being applied to knee plate 14, switch 68 is activated and sends an air signal to automatically activate a vacuum apparatus, not shown, to draw waste, such as scraps of material and pieces of cut thread to a waste chamber (not shown) to keep the work area clear of dust and debris during machine operation.

The described construction of transversely (laterally) extending knee press 16 and attachments thereto provide for two stages of pressure to be applied. In the first stage switch 108 is activated and the air signal generated thereby activates the usual sewing machine presser foot to lift up, releasing the fabric (not shown) which is held therebeneath during sewing. At the same time, an air signal is sent to cylinder 52 which fires its piston outwardly and stops the larger knee plate 14 from continuing to cause activation of the speed control device 44.

By continuing the sideways knee pressure on press 15 past the first contact point, the operator then activates a second stage by contacting switch 100, which signals air pressure activation of cylinder 50 and releases air pressure in cylinder 54. This position is commonly known in the industrial sewing industry as the "thread trim" or "full heel back" position on a speed control, the latter term being applicable when a foot pedal control assembly is in use. A signal is thus caused to activate raising of the needle from the fabric being sewed with machine M and cutting of the threads from such fabric to the machine.

It must be understood that all of the foregoing steps of machine operation are performed with knee control mechanism 12 without the operator ever needing to raise either foot from the floor. Thus, vastly improved operator body positioning is maintained throughout the manufacturing operation, reducing fatigue and injuries and raising efficiency and productivity.

Accordingly, the new machine knee control mechanism provides greater operator comfort while allowing the operator to maintain full control of the machine in the stand-up position. Mechanism 12 is adjustable in many aspects for the benefit of the operator's positioning and to increase versatility in application to existing machinery. Furthermore, the operator can have the option to use the knee control in either the left or right lateral press modes, as described. By appropriately adjusting the height of mechanism 12 (eg. when mounted on foot pedal assembly F), the operator can have the control assembly positioned however is most comfortable for his or her own particular use, with or without moving the level or angle of the work surface. Conceivably, although unlikely, the operator may even work in a seated position. Of course, this position may be somewhat awkward with regard to forward knee movement.

The various structural and functional adaptations of mechanism 12 permit the operator to maintain desired sewing speed and still have full control needed to operate various known machine options, such as, in this case, the needle positioner, "back tack" and machine presser foot lift functions, all with both feet on the floor. Moreover, as discussed, the structural aspects of mechanism 12 permit it to be used with either of the known sewing machine clutch and electronically controlled motor types.

In view of the foregoing, it will be seen that the several objects of the invention are achieved and other advantages are attained.

Although the foregoing includes a description of the best mode contemplated for carrying out the invention, various modifications are conceived. For example, additional fluid cylinders and switches could be added to cause the machine to perform additional functions. Also, variations in placement and attachment of parts to accommodate adaption of mechanism 12 to existing or new equipment can be made as necessary, without affecting the general structure and function of the new knee control mechanism by which the operator can control a machine without the necessity of having all of his or her body weight supported by one leg during at least part of the machine operation.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A knee control mechanism for operation of a machine, the mechanism comprising at least one rigid surface positioned for contact by a machine operator's knee and operatively connected to the machine in such manner as to cause operation of the machine upon contact by a knee of the operator while the operator is standing with both feet firmly placed on the floor at all times during operation of the machine, wherein the knee control mechanism is positioned forwardly of and substantially entirely to one side of the operator, and further having at least one support bar connected to the at least one rigid surface and adjustably mounted in relation to the machine in such manner as to provide the machine operator with selective placement of the at least one rigid surface, to suit the needs of a particular operator, and at least one pivotal lever, wherein the at least one support bar is adjustably mounted at one end of the at least one pivotal lever, to thereby cause pivotal movement of the lever upon pressing contact of the rigid surface by a knee of the operator of the machine, and further comprising at least one fluid cylinder connected to the machine and disposed for releasable contact by the at least one lever upon movement of the at least one rigid surface by the knee of a machine operator, to thereby control operation of the machine, wherein the at least one rigid contact surface comprises a knee plate disposed vertically with a surface thereof directly in front of the machine operator's knees for selective pushing contact thereby, and a press disposed vertically to one side of the operator at the operator's knee level, substantially perpendicular to the rigid plate, for selective lateral pressing contact by the operator's knee on the corresponding side.

2. The knee control mechanism of claim 1, wherein the machine is supported on a surface and the mechanism further comprises at least one flat rigid member vertically and transversely disposed and connectors for mounting the mechanism by the at least one flat rigid member beneath the support surface for the machine operated by the knee control mechanism.

3. The knee control mechanism of claim 1, wherein the entire mechanism is vertically adjustable with relation to the floor, so as to be selectively vertically positionable to suit the needs of a particular operator.

4. The knee control mechanism of claim 3, wherein such vertical adjustment of the mechanism is independent of the level of a surface upon which the machine being operated is supported.

5. The mechanism of claim 1, wherein the knee control mechanism is positioned forwardly of and substantially entirely to the left side of the operator.

6. A knee control mechanism for operation of a machine by an operator in the standing position, the mechanism comprising:

a plurality of rigid surfaces operatively mounted in connection with the machine, and positioned for selective contact by a knee of the operator of the machine, a plurality of fluid cylinders selectively contacted by the plurality of rigid surfaces, and a speed control device connected to at least one of the plurality of fluid cylinders and controlled by selective activation of at least one of the plurality of rigid surfaces by the machine operator's knee.

7. The knee control mechanism of claim 6, wherein the machine is mounted on a support stand and the knee control mechanism is mounted thereunder in such manner that the height of the knee control mechanism is selectively variable without movement of the position of the machine support surface of the support stand for optimal operator comfort, to thereby improve operator productivity.

8. The knee control mechanism of claim 7, wherein at least one of the plurality of knee contact surfaces is longitudinally adjustable in relation to a longitudinal axis of the support stand.

9. The knee control mechanism of claim 7, wherein at least one of the plurality of knee contact surfaces is transversely adjustable in relation to the longitudinal axis of the support stand.

10. The knee control mechanism of claim 7 wherein the entire knee control mechanism is vertically adjustable relative to a floor upon which the machine support stand is disposed.

11. The combination of a machine and a knee control mechanism therefor, wherein the knee control mechanism comprises:

at least one rigid surface operatively connected to the machine in such manner as to cause upon contact with the rigid surface by a knee of the operator operation of the machine while the operator is standing with both feet firmly placed on the floor at all times during operation of the machine, and further wherein the knee control mechanism is positioned forwardly of and substantially entirely to one side of the operator, and further having at least one support bar connected to the at least one rigid surface and adjustably mounted in relation to the machine in such manner as to provide the machine operator with selective placement of the at least one rigid surface, to suit the needs of a particular operator, and further having at least one support bar connected to the at least one rigid surface and adjustably mounted in relation to the machine in such manner as to provide the machine operator with selective placement of the at least one rigid surface, to suit the needs of a particular operator, and at least one pivotal lever, wherein the at least one support bar is adjustably mounted at one end of the at least one pivotal lever, to thereby cause pivotal movement of the lever upon pressing contact of the rigid surface by a knee of the operator of the machine, and further comprising at least one fluid cylinder connected to the machine and disposed for releasable contact by the at least one lever upon movement of the at least one rigid surface by the knee of a machine operator, to thereby control operation of the machine, wherein the at least one rigid contact surface comprises a knee plate disposed vertically with a surface thereof directly in front of the machine operator's knees for selective pushing contact thereby, and a press disposed vertically to one side of the operator at the operator's knee level, substantially perpendicular to the rigid plate, for selective lateral pressing contact by the operator's knee on the corresponding side.

12. The combination of claim 11, wherein the machine is an industrial sewing machine of a type used in the garment industry.

13. The combination of claim 12, wherein the sewing machine has a motor of the electronically controlled type, which motor is connected to the knee control mechanism for selective control thereby.

14. The combination of claim 1, wherein the machine is mounted on a support stand which has a machine support surface which is tiltable and vertically adjustable to suit the operator of the machine.

15. A knee control mechanism for operation of a machine, the mechanism comprising at least one rigid surface positioned for contact by a machine operator's knee and operatively connected to the machine in such manner as to cause operation of the machine upon contact by a knee of the operator while the operator is standing with both feet firmly placed on the floor at all times during operation of the machine, wherein the knee control mechanism is positioned forwardly of and substantially entirely to one side of the operator, and further having at least one support bar connected to the at least one rigid surface and adjustably mounted in relation to the machine in such manner as to provide the machine operator with selective placement of the at least one rigid surface, to suit the needs of a particular operator, wherein the entire mechanism is vertically adjustable with relation to the floor, so as to be selectively vertically positionable to suit the needs of a particular operator, and further wherein the knee control mechanism is attached to a vertically adjustable foot pedal assembly so that vertical adjustment of the knee control mechanism with relation to the floor is attained simultaneously with vertical adjustment of the foot pedal assembly.

16. The knee control mechanism of claim 15, wherein the adjustable foot pedal assembly and the knee control mechanism mounted thereon are also adjustable toward and away from the operator of the machine.

* * * * *